US008449335B2

(12) United States Patent
Briant et al.

(10) Patent No.: US 8,449,335 B2
(45) Date of Patent: May 28, 2013

(54) ELECTRICAL CONNECTORS AND RECEPTACLE ASSEMBLIES HAVING RETENTION INSERTS

(75) Inventors: Eric David Briant, Dillsburg, PA (US); James Charles Shiffler, Hummelstown, PA (US); Melissa Anne Harden, Harrisburg, PA (US); Bryon Todd Eppley, Marysville, PA (US); Craig William Clewell, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/089,094

(22) Filed: Apr. 18, 2011

(65) Prior Publication Data

US 2012/0264336 A1 Oct. 18, 2012

(51) Int. Cl.
*H01R 24/00* (2011.01)

(52) U.S. Cl.
USPC ..... 439/637

(58) Field of Classification Search
USPC ..... 439/636, 637, 942
See application file for complete search history.

(56) References Cited

U.S. PATENT DOCUMENTS

| | | | | | |
|---|---|---|---|---|---|
| 3,594,699 | A * | 7/1971 | Jayne et al. | ..... | 439/325 |
| 3,670,290 | A * | 6/1972 | Angele et al. | ..... | 439/325 |
| 3,744,005 | A * | 7/1973 | Sitzler | ..... | 439/260 |
| 3,958,852 | A * | 5/1976 | Abraham et al. | ..... | 439/355 |
| 3,990,761 | A * | 11/1976 | Jayne | ..... | 439/267 |
| 4,025,147 | A * | 5/1977 | Van Arsdale et al. | ..... | 439/634 |
| 4,077,688 | A * | 3/1978 | Cobaugh et al. | ..... | 439/267 |
| 4,501,465 | A * | 2/1985 | Hoshino et al. | ..... | 439/633 |
| 5,820,392 | A * | 10/1998 | Lin et al. | ..... | 439/108 |
| 6,129,594 | A * | 10/2000 | Lai | ..... | 439/701 |
| 6,491,536 | B1 * | 12/2002 | Torii | ..... | 439/246 |
| 6,743,053 | B2 * | 6/2004 | Wu | ..... | 439/634 |
| 6,942,524 | B2 | 9/2005 | Wu | | |
| 7,210,955 | B2 | 5/2007 | Ringler et | | |
| 7,291,031 | B2 * | 11/2007 | Crofoot et al. | ..... | 439/265 |
| 7,351,091 | B1 | 4/2008 | Zhang | | |
| 7,553,191 | B2 * | 6/2009 | Su et al. | ..... | 439/637 |
| 7,710,734 | B2 | 5/2010 | Ice et al. | | |
| 7,833,068 | B2 | 11/2010 | Bright et al. | | |
| 7,859,849 | B2 | 12/2010 | Ice | | |
| 2004/0110398 | A1 | 6/2004 | Chen | | |

OTHER PUBLICATIONS

European Search Report, European Application No. EP 12 16 4049, European Filing Date Apr. 13, 2012.

* cited by examiner

*Primary Examiner* — Neil Abrams
*Assistant Examiner* — Travis Chambers

(57) ABSTRACT

An electrical connector including a connector housing having opposite mating and loading faces and a mating axis extending therebetween. The connector housing has interior walls that oppose each other with a contact cavity therebetween. The electrical connector also includes a retention insert that is sized and shaped to be advanced through the loading face and positioned within the contact cavity. The retention insert has an outer engagement surface. The electrical connector also includes first and second rows of mating contacts that are separated by the retention insert. The contact cavity has a component-receiving region that exists between the first and second rows of mating contacts and is accessible through the mating face. The mating contacts of the first and second rows are oriented to extend lengthwise along the mating axis and are held between the engagement surface of the retention insert and respective interior walls.

20 Claims, 6 Drawing Sheets

ELECTRICAL CONNECTORS AND RECEPTACLE ASSEMBLIES HAVING RETENTION INSERTS

BACKGROUND OF THE INVENTION

The subject matter herein relates generally to electrical connectors, and more particularly, to electrical connectors that are configured to receive and communicatively engage an edge of a mating connector.

Various communication or computing systems use electrical connectors for transmitting data signals between different components of the systems. For example, some electrical connectors may be configured to receive an edge of an electrical component having component contacts located therealong. The electrical connectors may include housing cavities having opposing rows of mating contacts. When the edge is advanced into the housing cavity of the electrical connector, the edge moves between the opposing rows of mating contacts. The component contacts electrically engage the mating contacts in the housing cavity.

Electrical connectors such as those described above may be manufactured by molding a housing with holes and then inserting the mating contacts through corresponding holes. Alternatively, the housing may be directly molded around the rows of mating contacts so that each mating contact is held in place by molded material that surrounds the mating contact. However, such electrical connectors may have certain limitations. For example, mating contacts that have shapes or dimensions that predispose the mating contacts to deformation may be inadvertently bent when inserted into the hole. Furthermore, molding the housing around the mating contacts may be costly as compared to other manufacturing methods. In some cases, the above manufacturing methods may limit a manufacturer's ability to design electrical connectors with improved performance.

Accordingly, there is a need for electrical connectors that are capable of being manufactured without damaging the mating contacts and/or manufactured in a less costly manner than known electrical connectors.

BRIEF DESCRIPTION OF THE INVENTION

In one embodiment, an electrical connector is provided that includes a connector housing having opposite mating and loading faces and a mating axis extending therebetween. The connector housing has interior walls that oppose each other with a contact cavity therebetween. The contact cavity is accessible through the mating face and through the loading face. The electrical connector also includes a retention insert that is sized and shaped to be advanced through the loading face and positioned within the contact cavity. The retention insert has an outer engagement surface. The electrical connector also includes first and second rows of mating contacts that are separated by the retention insert. The contact cavity has a component-receiving region that exists between the first and second rows of mating contacts and is accessible through the mating face. The mating contacts of the first and second rows are oriented to extend lengthwise along the mating axis and are held between the engagement surface of the retention insert and respective interior walls. The mating contacts of the first and second rows are configured to engage an electrical component when the electrical component is inserted into the component-receiving region.

In another embodiment, a receptacle assembly is provided that includes a circuit board having a board surface. The receptacle assembly also has an electrical connector that is configured to be mounted and electrically coupled to the board surface. The electrical connector includes a connector housing having opposite mating and loading faces and a mating axis extending therebetween. The connector housing has interior walls that oppose each other with a contact cavity therebetween. The contact cavity is accessible through the mating face and through the loading face. The electrical connector also includes a retention insert that is sized and shaped to be advanced through the loading face and positioned within the contact cavity. The retention insert has an outer engagement surface. The electrical connector also includes first and second rows of mating contacts that are separated by the retention insert. The contact cavity has a component-receiving region that exists between the first and second rows of mating contacts and is accessible through the mating face. The mating contacts of the first and second rows are oriented to extend lengthwise along the mating axis and are held between the engagement surface of the retention insert and respective interior walls. The mating contacts of the first and second rows are configured to engage an electrical component when the electrical component is inserted into the component-receiving region.

DETAILED DESCRIPTION OF THE INVENTION

Figure 1:
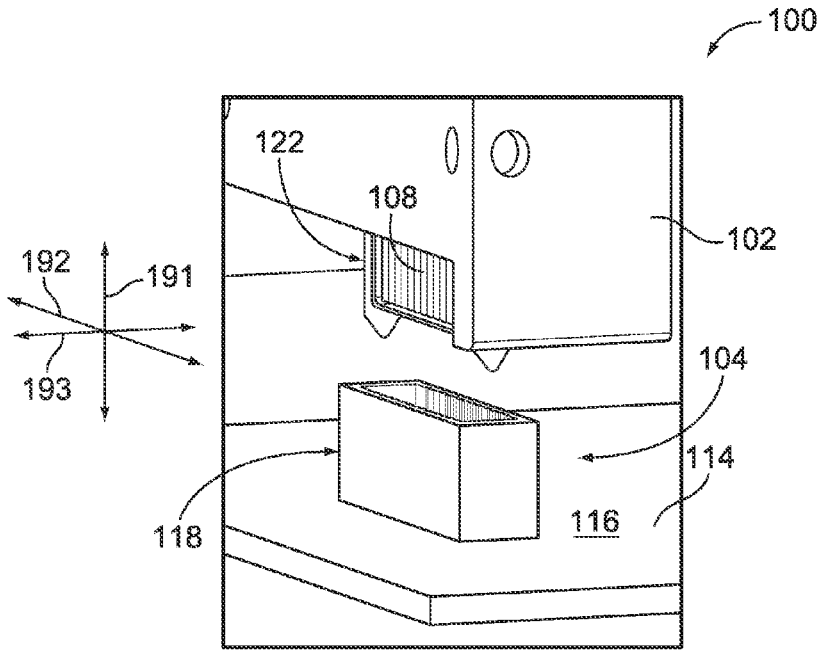
FIG. 1 is a perspective view of a communication system formed in accordance with one embodiment.
Figure 2:
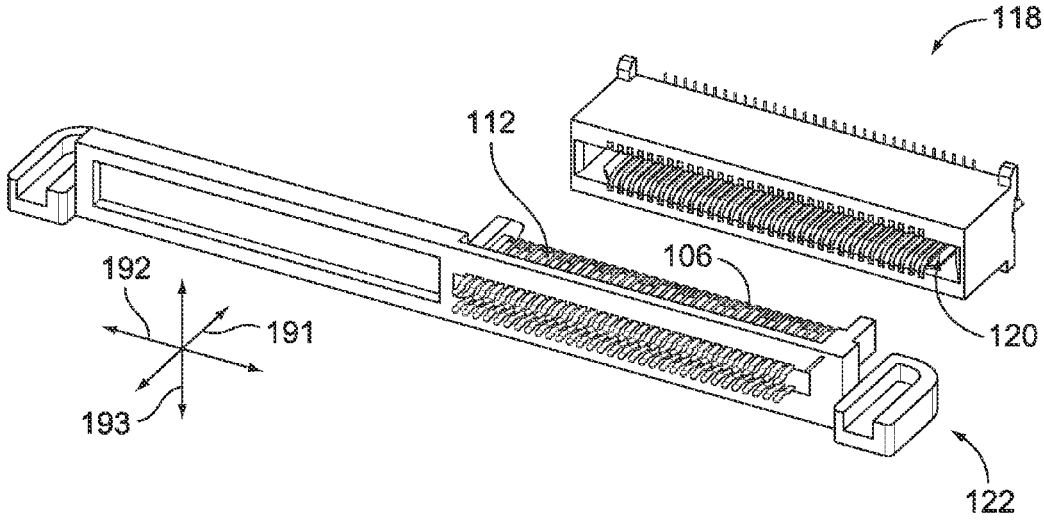
FIG. 2 is a perspective view of an electrical connector formed in accordance with one embodiment and also a mating connector that may be used in the communication system of FIG. 1.

FIG. 1 is a perspective view of a communication system 100 formed in accordance with one embodiment that includes an electrical connector 118 and a mating connector 122, and FIG. 2 is a perspective view of the electrical connector 118 and the mating connector 122. The communication system 100 may include an electrical component 102 (FIG. 1) that includes the mating connector 122 and a receptacle assembly 104 (FIG. 1) that includes the electrical connector 118 and is configured to communicatively engage the electrical component 102. As shown, the communication system 100 and the electrical and mating connectors 118, 122 are oriented with respect to mutually perpendicular axes 191-193, including a mating axis 191, a longitudinal axis 192, and an orientation axis 193. The electrical component 102 includes a first row of component contacts 108 (FIG. 1) and a second row of component contacts 112 (FIG. 2). The first and second rows of component contacts 108, 112 may be arranged parallel to each other along the longitudinal axis 192. The first row and the second row of component contacts 108, 112 may face in opposite directions along the orientation axis 193.

As shown in FIG. 1, the receptacle assembly 104 may include a circuit board 114 that has a board surface 116 having a plurality of electrical contacts (not shown). The electrical contacts may be, for example, contact pads or plated through-holes. The electrical connector 118 is configured to be mounted to the board surface 116. As shown in FIG. 2, the electrical connector 118 has a component-receiving region 120 that is configured to receive the electrical component 102. More specifically, the component-receiving region 120 is configured to receive a mating end or edge 106 of the mating connector 122 that has the component contacts 108, 112 located therealong. During a mating operation, the first and second rows of component contacts 108, 112 are advanced in a mating direction along the mating axis 191 into the component-receiving region 120. The component contacts 108, 112 are configured to electrically engage corresponding mating contacts 128, 130 (shown in FIG. 3) of the electrical connector 118 thereby communicatively coupling the circuit board 114 and the electrical component 102.

The electrical component 102 may be, for example, a solid state drive and the electrical connector 118 may be configured to communicatively couple to the solid state drive. However, in alternative embodiments, the electrical connector 118 may be an edge-to-edge or straddle-mount connector that receives and holds a circuit board. In the illustrated embodiment, the electrical connector 118 is a vertical connector because the component-receiving region 120 of the electrical connector 118 opens away from the board surface 116. However, in alternative embodiments, the electrical connector 118 may be a right-angle connector in which the component-receiving region 120 opens in a direction that is parallel to the plane of the board surface 116. The electrical connector 118 may have other geometries as well.

In some embodiments, the electrical connector 118 is configured to transmit high-speed data signals, such as data signals greater than about 10 gigabits/second (Gbs) or data signals greater than about 15 Gbs. In particular embodiments, the electrical connector 118 is configured to transmit data signals at speeds above 20 Gbs and up to about 24 Gbs or more.

Figure 3:
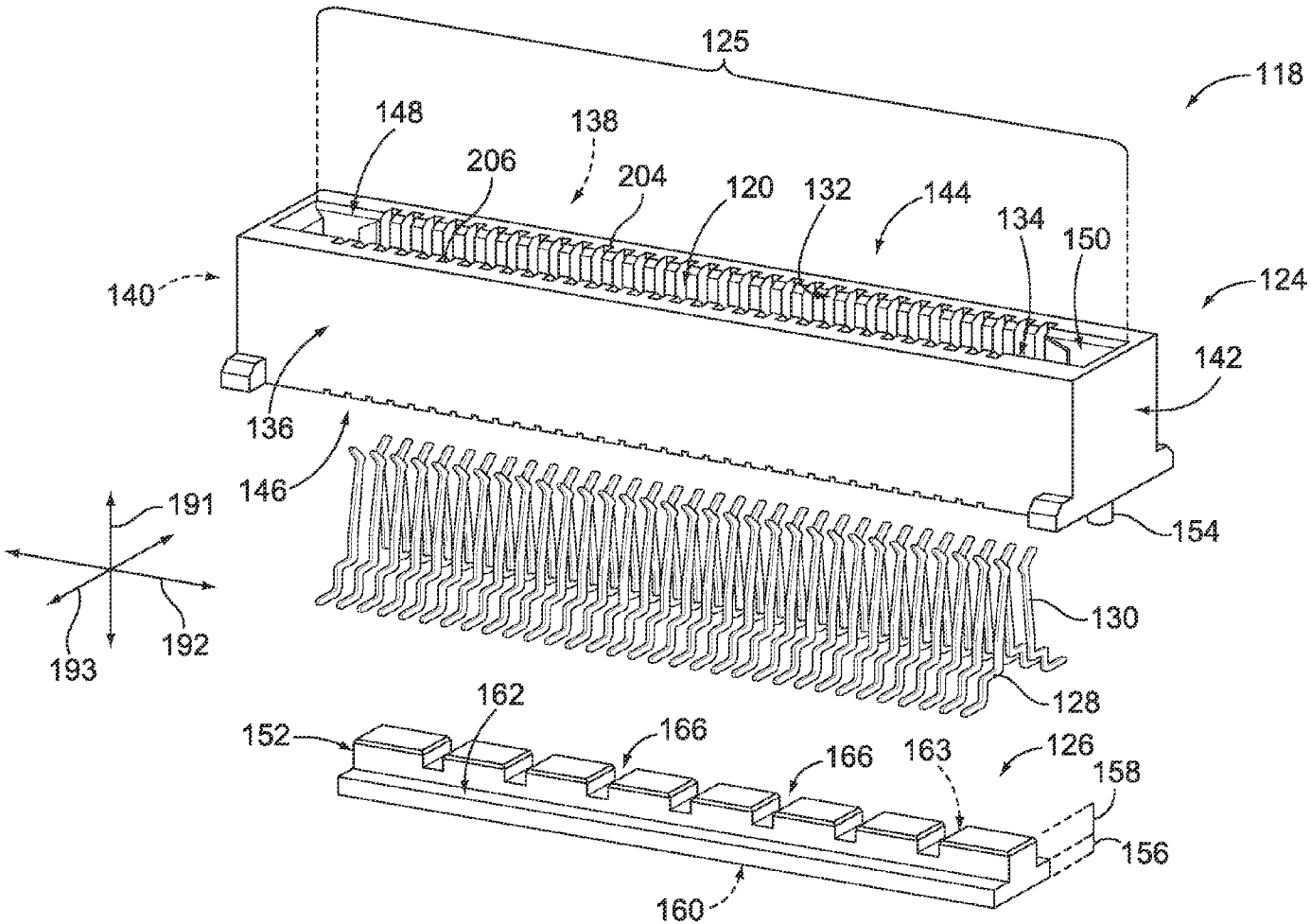
FIG. 3 is an exploded view of the electrical connector of FIG. 2.

FIG. 3 is an exploded view of an electrical connector 118 formed in accordance with one embodiment. As shown, the electrical connector 118 may include a connector housing 124, a retention insert 126, and a plurality of the mating contacts 128, 130. The connector housing 124 may have interior walls 132, 134 that oppose each other with a contact cavity 125 therebetween. The mating contacts 128, 130 and the retention insert 126 are positioned within the contact cavity 125 when the electrical connector 118 is fully assembled. The contact cavity 125 includes the component-receiving region 120. The mating contacts 128 may be arranged in a first row, and the mating contacts 130 may be arranged in a second row that opposes the first row. When the electrical connector 118 is fully assembled, the first and second rows of mating contacts 128, 130 are held between the connector housing 124 and the retention insert 126 within the contact cavity 125. For example, the first row of mating contacts 128 may be located within contact channels 206 of the interior wall 134 and held between the retention insert 126 and the interior wall 134. The second row of mating contacts 130 may be located within contact channels 204 of the interior wall 132 and held between the retention insert 126 and the interior wall 132. When the electrical connector 118 is assembled, the component-receiving region 120 exists between the first and second rows of mating contacts 128, 130.

In the illustrated embodiment, the connector housing 124 is capable of independently holding the mating contacts 128, 130 before the retention insert 126 is positioned within the contact cavity 125. However, in alternative embodiments, the retention insert 126 may be capable of independently holding the mating contacts 128, 130 before the retention insert 126 is positioned within the connector housing 124. In another alternative embodiment, neither the connector housing 124 nor the retention insert 126 is capable of independently holding the mating contacts 128, 130.

The connector housing 124 may have opposite housing sides 136, 138 that extend along a plane that includes the mating axis 191 and the longitudinal axis 192. The housing sides 136, 138 may face in generally opposite directions along the orientation axis 193. The connector housing 124 may also have opposite sidewalls 140, 142 that extend along a plane that includes the mating axis 191 and the orientation axis 193. The sidewalls 140, 142 may face in generally opposite directions along the longitudinal axis 192. In the illustrated embodiment, the connector housing 124 is substantially block-shaped. However, the connector housing 124 may have other geometries in alternative embodiments.

Also shown, the connector housing 124 may have opposite mating and loading faces 144, 146. The mating axis 191 extends between the mating and loading faces 144, 146, and the mating and loading faces 144, 146 face in generally opposite directions along the mating axis 191. The loading face 146 is configured to be mounted to an electrical component, such as the circuit board 114 (FIG. 1). The loading face 146 may be mounted to the board surface 116 (FIG. 1). In alternative embodiments, such as when the electrical connector 118 is a right-angle connector, the mating and loading faces 144, 146 may not face in generally opposite directions, but may face in directions that are substantially perpendicular to each other.

The connector housing 124 may include one or more alignment features, such as cavities, recesses, edges, posts, and the like that facilitate aligning the connector housing 124 with either or both of the electrical components (e.g., the electrical component 102 and the circuit board 114). Such alignment features may be configured to engage corresponding alignment features of the other electrical component. For example, the connector housing 124 may define one or more spatial regions 148, 150 that are proximate to the component-receiving region 120. In the illustrated embodiment, the contact cavity 125 includes the component-receiving region 120 and the spatial regions 148, 150 such that the component-receiving region 120 and the spatial regions 148, 150 are portions of a common space. However, in alternative embodiments, the component-receiving region 120 may be separated from the spatial regions 148, 150. The spatial regions 148, 150 are sized and shaped to receive a corresponding alignment feature of the electrical component 102.

Also shown in FIG. 3, the loading face 146 may include one or more posts 154 that are configured to be inserted into holes (not shown) of the circuit board 114 to properly align the electrical connector 118. In alternative embodiments, the connector housing 124 may include posts or other projections that extend away from the mating face 144 to be received by corresponding spatial regions of the electrical component 102. Furthermore, in alternative embodiments, the loading face 146 may include spatial regions that are sized and shaped to receive posts that are attached to the circuit board 114.

The contact cavity 125 may be accessible through the mating face 144 and also through the loading face 146. For example, the mating contacts 128, 130 and the retention insert 126 are configured to be inserted into the contact cavity 125 through the loading face 146. In the illustrated embodiment, the contact cavity 125 is completely or entirely surrounded by the connector housing 124 and opens in opposite directions along the mating axis 191. For example, the housing sides 136, 128 and the sidewalls 140, 142 completely surround the contact cavity 125. However, in alternative embodiments, the connector housing 124 may only surround a portion of the contact cavity 125. For instance, the connector housing 124 may only comprise the housing sides 136, 138 and the sidewall 140. A gap may exist where the sidewall 142 is located in the illustrated embodiment. Instead, the retention insert 126 may be sized and shaped to fill in the gap.

The retention insert 126 is sized and shaped to be advanced through the loading face 146 and positioned within the contact cavity 125. The retention insert 126 extends lengthwise along the longitudinal axis 192 when positioned within the connector housing 124. As shown, the retention insert 126 includes an outer engagement surface 152. In the illustrated embodiment, the engagement surface 152 directly engages the mating contacts 128, 130 and interfaces with the connector housing 124, which may or may not include directly contact.

As shown, the retention insert 126 may include a platform portion 156 and a cavity portion 158. The engagement surface 152 may extend along both of the platform and cavity portions 156, 158. The platform portion 156 may have an insert side 160 that faces in an opposite direction with respect to the engagement surface 152. The insert side 160 may form a portion of the loading face 146 when the retention insert 126 is positioned within the contact cavity 125. The platform portion 156 may include shoulder sections 162, 163 that are separated by the cavity portion 158. The shoulder sections 162, 163 may face in a direction along the mating axis 191 toward the mating face 144. At least a portion of the shoulder sections 162, 163 may extend along a plane that is substantially perpendicular to the mating axis 191. As such, the retention insert 126 may be substantially T-shaped. Also shown, the cavity portion 158 may extend along the platform portion 156 and include a plurality of recesses 166.

Figure 4:
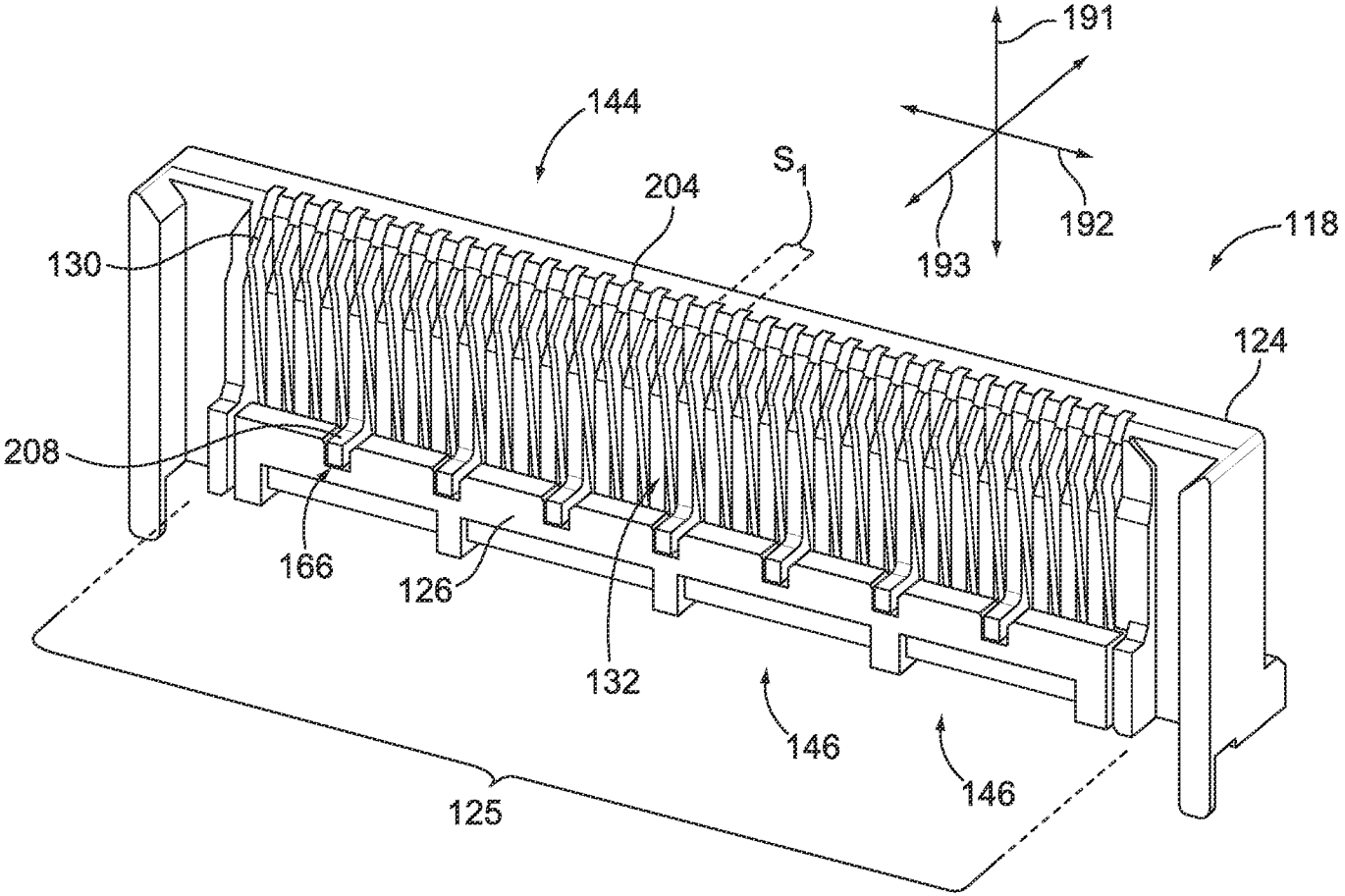
FIG. 4 illustrates a cross-section of the electrical connector of FIG. 2.

FIG. 4 shows a cross-section of the electrical connector 118 illustrating a portion of the contact cavity 125 and various features therein. Although FIG. 4 only illustrates one half of the exemplary contact cavity 125, the opposite half may include similar features. As shown, the interior wall 132 may be shaped to define a plurality of the contact channels 204. The contact channels 204 may be distributed along a length of the interior wall 132 parallel to the longitudinal axis 192. The contact channels 204 extend parallel to the mating axis 191. Adjacent contact channels 204 may be separated from each other by a centerline spacing $S_1$. Also shown, the connector housing 124 may include bridge supports 208 that extend parallel to the orientation axis 193 between the interior wall 134 (FIG. 3) and the interior wall 132. The bridge supports 208 mechanically join the interior walls 132, 134 and are configured to prevent the interior walls 132, 134 from separating when the retention insert 126 is moved between the first and second rows of mating contacts 128 (FIG. 3), 130. As shown, the bridge supports 208 are spaced apart from each other along the length of the interior wall 132.

When the electrical connector 118 is assembled, the mating contacts 130 are inserted into corresponding contact channels 204. The mating contacts 130 form the first row when located within the contact channels 204. In the illustrated embodiment, the mating contacts 130 are inserted through the loading face 146, but may be inserted through the mating face 144 in other embodiments. The mating contacts 130 may be held by the connector housing 124 within the contact channels 204. For example, the connector housing 124 may form an interference fit with each of the mating contacts 130. In the exemplary embodiment, after the mating contacts 130 are located within the corresponding contact channels 204, the retention insert 126 may be advanced through the loading face 146 along the mating axis 191. The recesses 166 are configured to receive the bridge supports 208 when the retention insert 126 is advanced therein. The bridge supports 208 and the retention insert 126 may form a substantially flush surface.

Figure 5:
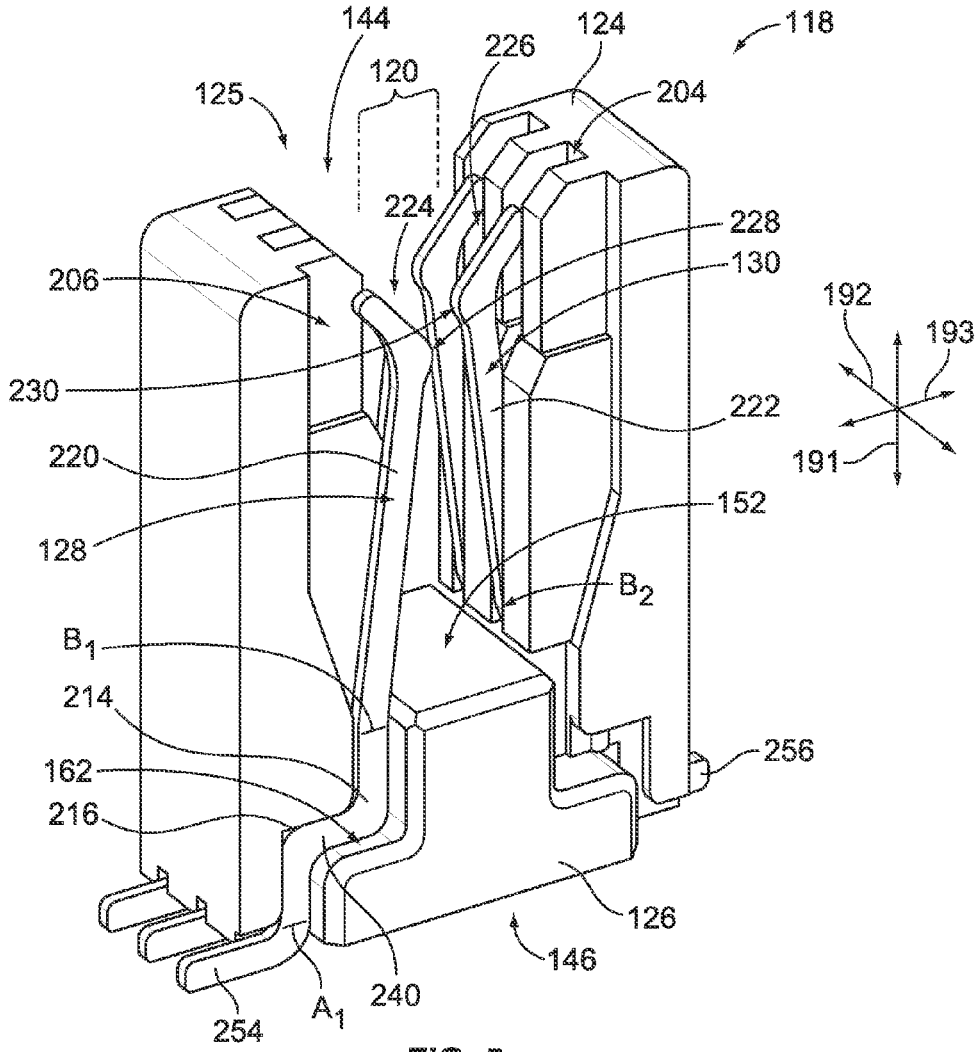
FIG. 5 is an enlarged cross-section of the electrical connector of FIG. 2 illustrating various features.

FIG. 5 is an enlarged cross-section of the electrical connector 118. The enlarged cross-section in FIG. 5 illustrates the connector housing 124 and the first and second rows (FIG. 3) of the mating contacts 128, 130. The mating contacts 130, 128 are located in corresponding contact channels 204, 206, respectively. When the retention insert 126 is advanced into the contact cavity 125 through the loading face 146, the retention insert 126 may engage the mating contacts 130, 128. The mating contacts 130, 128 may be pressed against the interior walls 132, 134 (FIG. 3) of the connector housing 124 by the engagement surface 152 of the retention insert 126. In some embodiments, the mating contacts 130, 128 collectively hold the retention insert 126 in the contact cavity 125, and the retention insert 126 does not contact any portion of the connector housing 124. The retention insert 126 and the connector housing 124 may hold the mating contacts 128, 130 therebetween along corresponding interference sections 214 of the mating contacts 128, 130, respectively. (Only the interference section 214 is shown with respect to the mating contact 128, but the mating contact 130 may also include an interference section 214.)

The engagement surface 152 may generally face toward the mating face 144 in a direction that is parallel to the mating axis 191. The engagement surface 152 and the mating contacts 128, 130 may have complementary contours such that a corresponding path of the mating contacts 128, 130 extends generally alongside the engagement surface 152. In such embodiments, the engagement surface 152 may be shaped to resist movement of the mating contacts 128, 130 in the mating direction when the electrical component 102 (FIG. 1) engages the mating contacts 128, 130.

As shown in FIG. 5, the interference section 214 of the mating contact 128 extends from point $A_1$ to point $B_1$ along the mating contact 128. The interference section 214 includes one or more portions of the mating contact 128 that directly engage the connector housing 124 and the retention insert 126. For example, the shoulder section 162 of the engagement surface 152 may directly engage the mating contact 128. The connector housing 124 may have a housing-contact surface 216 that directly engages the mating contact 128. The housing contact surface 216 and the shoulder section 162 may directly oppose each other with the mating contact 128 pressed therebetween. In addition to the above example, the connector housing 124 and/or the retention insert 126 may directly engage the mating contact 128 at other portions along the interference section 214.

The mating contacts 128, 130 may also include contact tails 254, 256, respectively. The contact tails 254, 256 are configured to be coupled to corresponding electrical contacts (not shown) of the circuit board 114 (FIG. 1). For example, the contact tails 254, 256 may be soldered to contact pads or inserted into plated thru-holes. In addition, the mating contacts 128, 130 may include movable beams 220, 222, respectively. The movable beam 220 may extend from about the point $B_1$ to a distal end 224 of the mating contact 128. The movable beam 222 may extend from about a point $B_2$ to a distal end 226 of the mating contact 130. The mating contacts 128, 130 may have mating features 228, 230, respectively, that are proximate to the distal ends 224, 226, respectively. The movable beams 220, 222 represent portions of the mating contacts 128, 130 that move when the mating contacts 128, 130 engage the electrical component 102. For example, when the edge 106 (FIG. 2) of the mating connector 122 (FIG. 1) advances into the contact cavity 125, the movable beams 220, 222 may be deflected away from each other in respective directions along the orientation axis 193. The mating features 228, 230 may slide along corresponding surfaces of the electrical component 102 and engage corresponding component contacts 112. Biasing forces from the deflected mating contacts 128, 130 may press the mating features 228, 230 against the corresponding component contacts 112 to maintain an electrical connection throughout operation of the electrical connector 118.

In the illustrated embodiment, the mating contacts 128, 130 may be stamped from a conductive sheet of material. In particular embodiments, a thickness of the mating contacts 128, 130 may be less than about 0.2 mm, and a width (measured from one stamped edge to the other) of the mating contacts 128, 130 may be less than about 0.5 mm. In some embodiments, the mating contacts 128, 130 may have a substantially uniform cross-section along the respective interference sections 214. The mating contacts 128, 130 may also have substantially uniform cross-sections along the respective movable beams 220, 222 until the mating features 228, 230, respectively.

As shown in FIG. 5, a corresponding path of the mating contact 128 along the interference section 214 may be nonlinear and, more specifically, have a contoured shape with one or more curves. For example, the interference section 214 may include at least one orthogonal segment 240. The orthogonal segment 240 extends in a direction that is substantially perpendicular to the mating axis 191 and substantially parallel to the orientation axis 193. Although not shown, the mating contact 130 may also include an orthogonal segment that is similar to the orthogonal segment 240. When the electrical component 102 engages the mating contacts 128, 130, the orthogonal segments 240 may facilitate preventing the mating contacts 128, 130 from moving or being displaced in the mating direction.

Figure 6:
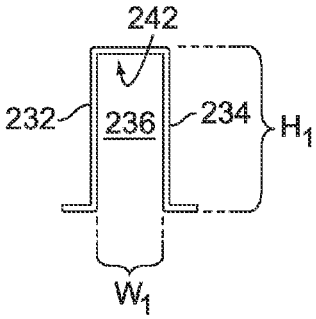
FIG. 6 illustrates a base portion of a contact channel that may be used in the electrical connector of FIG. 2.
Figure 7:
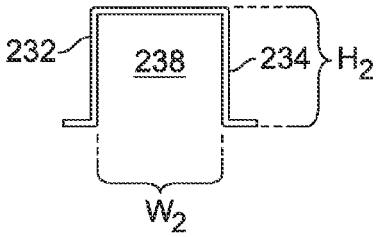
FIG. 7 illustrates an end portion of a contact channel that may be used in the electrical connector of FIG. 2.

FIGS. 6 and 7 illustrated different cross-sections of the contact channel 204 (FIG. 3). The contact channel 206 (FIG. 3) may have similar features. FIG. 6 illustrates a base portion 236 of the contact channel 204 that is configured to have the movable beam 222 (FIG. 5) move therein, and FIG. 7 illustrates an end portion 238 of the contact channel 204 that is configured to have the distal end 226 (FIG. 5) move therein. In some embodiments, cross-sectional dimensions of the contact channel 204 may be configured to control impedance of the electrical connector 118. By way of example only, the cross-sectional dimensions of the contact channel 204 may be configured to maintain impedance throughout the electrical connector 118 at about 85 ohms or at about 100 ohms. For instance, dielectric material may be increased thereby decreasing air surrounding the mating contact 130 (FIG. 1) or dielectric material may be decreased thereby increasing the air that surrounds the mating contact 130.

As shown in FIG. 6, the base portion 236 of the contact channel 204 may be defined between opposing channel walls 232, 234. The cross-section of the contact channel 204 has a channel width $W_1$ and a height $H_1$. The channel width $W_1$ is measured along the longitudinal axis 192 (FIG. 1) between the channels walls 232, 234. The height $H_1$ is measured along the orientation axis 193 (FIG. 1) from a channel surface 242 to a point where the contact channel 204 opens into the component-receiving region 120 (FIG. 2). As shown in FIG. 7, the cross-section of the end portion 238 of the contact channel 204 has a channel width $W_2$ and a height $H_2$.

In some embodiments, the channel widths $W_1$ and $W_2$ may be differently sized. For example, the channel width $W_2$ may be greater than the channel width $W_1$. The channels walls 232, 234 along the base portion 236 of the contact channels 204 may be greater in thickness than the channels walls 232, 234 along the end portion 238. In such embodiments, the channel walls 232, 234 may provide a greater dielectric effect on the mating contacts 130 (FIG. 3) thereby decreasing the impedance along the base portion 236. Furthermore, in such embodiments, the contact channels 204 may have a greater air gap at the end portion 238 where the mating contacts 130 electrically engage the electrical component 102 (FIG. 1) thereby increasing the impedance along the end portion 238. Likewise, a cross-section of the contact channel 204 in FIG. 8 may have a width $W_3$ that is greater than the width $W_1$ in order to increase the impedance.

Figure 8:
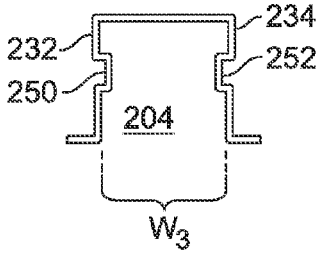
FIG. 8 illustrates grip elements that may be used in the contact channels of the electrical connector of FIG. 2.

FIG. 8 is a cross-section of the contact channel 204 where the interference section of the mating contact 130 (FIG. 3) is held. The mating contact 128 may also be held in the contact channel 206 in a similar manner. As shown, the connector housing 124 (FIG. 3) may have grip elements 250, 252 that extend into the contact channel 204 from the channel walls 232, 234, respectively. The grip elements 250, 252 oppose each other across the contact channel 206. In particular embodiments, the mating contact 130 is inserted into the contact channel 204 and held by the connector housing 124 before the retention insert 126 (FIG. 3) is advanced into the contact cavity 125 (FIG. 3). The grip elements 250, 252 are configured to grip the mating contact 130 therebetween. In alternative embodiments, the connector housing 124 may have other features that effectively hold the mating contacts 130. For example, the connector housing 124 may have latches, or a channel width between the channel walls 232, 234 may be configured to form an interference fit with the mating contact 130.

Figure 9:
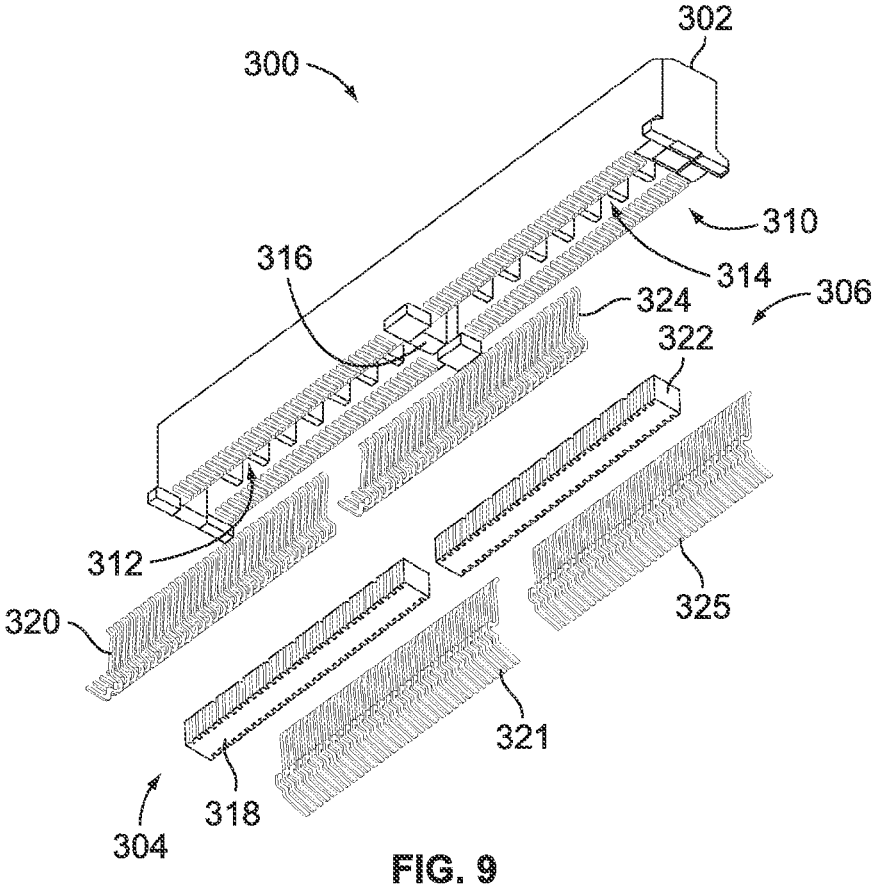
FIG. 9 is a bottom exploded view of an electrical connector formed in accordance with another embodiment.
Figure 10:
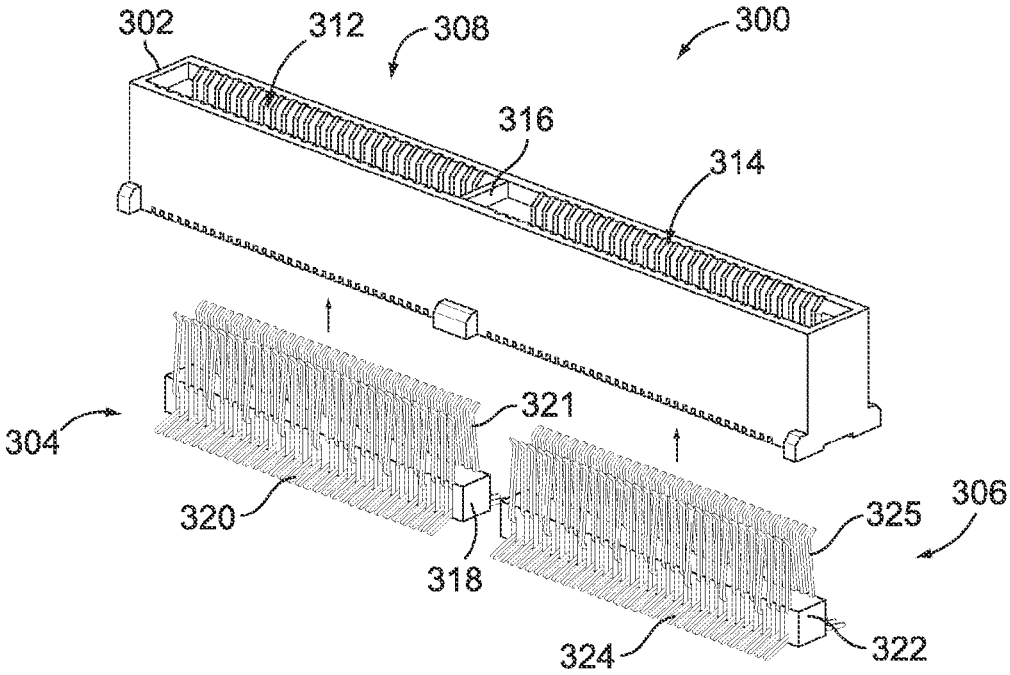
FIG. 10 is a perspective view of the electrical connector of FIG. 9 illustrating contact sub-assemblies before insertion into a connector housing.

FIG. 9 is a bottom exploded view of an electrical connector 300 formed in accordance with another embodiment, and FIG. 10 is a partially exploded perspective view of the electrical connector 300. The electrical connector 300 may have similar features as the electrical connector 118 (FIG. 1). As shown, the electrical connector 300 includes a connector housing 302 and contact sub-assemblies 304, 306. As shown, the connector housing 302 has a mating face 308 (FIG. 10) and a loading face 310 (FIG. 9) and includes housing cavities 312, 314 that are separated by a partition 316. As shown in both FIGS. 9 and 10, the contact sub-assembly 304 includes a retention insert 318 and first and second rows of mating contacts 320, 321. The contact sub-assembly 306 includes a retention insert 322 and first and second rows of mating contacts 324, 325. In the illustrated embodiment, the retention inserts 318, 322 are configured to independently hold the respective mating contacts before the retention inserts 318, 322 are inserted into the housing cavities 312, 314.

Figure 11:
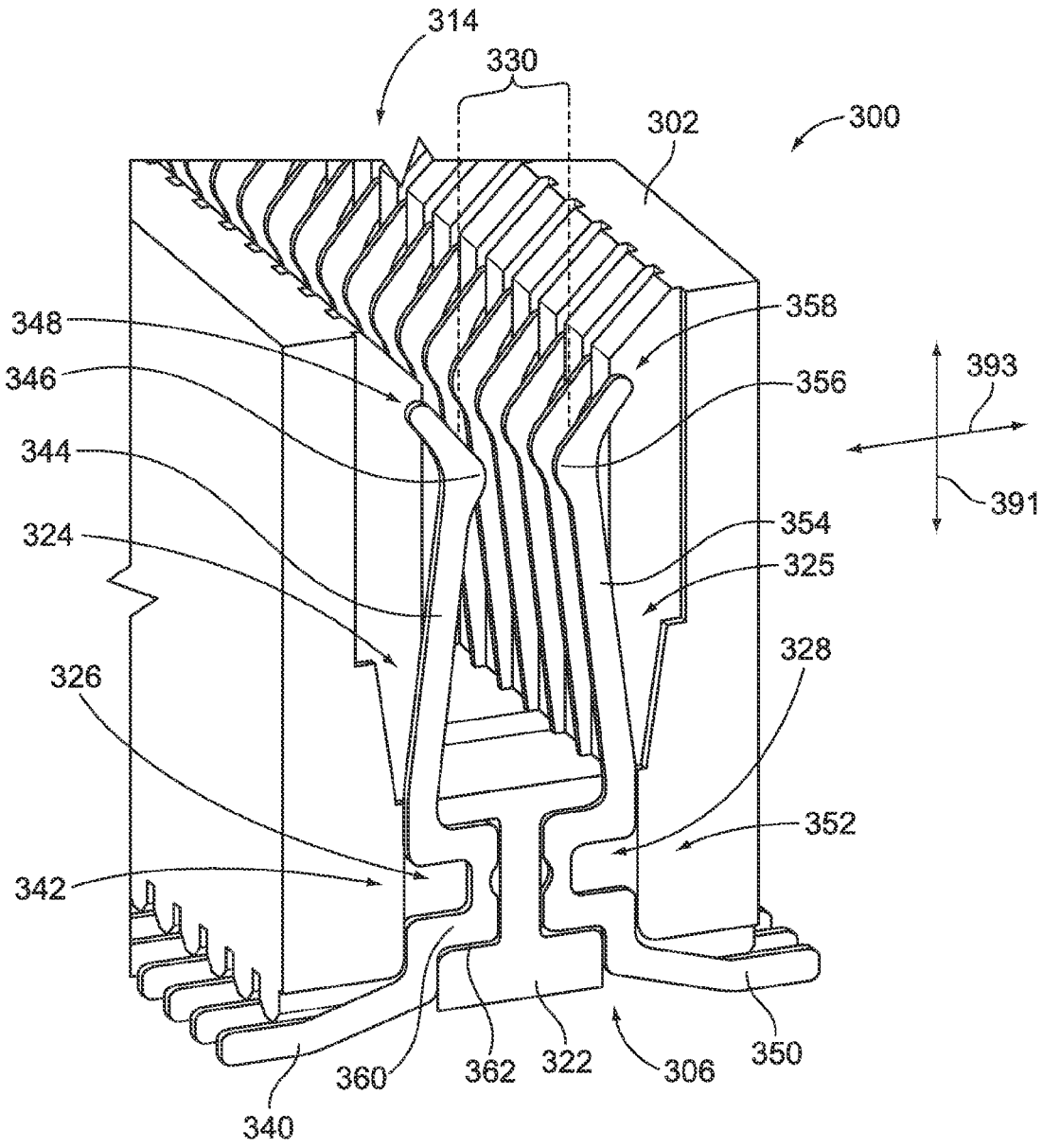
FIG. 11 is an enlarged cross-section of the electrical connector of FIG. 9 illustrating various features.

FIG. 11 is an enlarged cross-section of the electrical connector 300 along the contact cavity 314 having the retention insert 322 positioned therein. As shown, the mating contact 324 includes a contact tail 340, a movable beam 344, a mating feature 346, and a distal end 348 that may be similar to the corresponding features of the mating contacts 128, 130 (FIG. 3). The mating contact 325 includes a contact tail 350, a movable beam 354, a mating feature 356, and a distal end 358 that may be similar to the corresponding features of the mating contacts 128, 130.

The retention insert 322 is capable of holding the mating contacts 324, 325 of the first and second rows before the retention insert 322 is positioned within the connector housing 302. As shown, the retention insert 322 includes slots 326, 328. Similar to the retention insert 126, the retention insert 322 is configured to facilitate holding the mating contacts 324, 325 within the contact cavity 314 and prevent the mating contacts 324, 325 from being displaced when an electrical component (not shown) is inserted into a component-receiving region 330 of the contact cavity 314. For example, the slots 326, 328 may be sized and shaped relative to interference sections 342, 352. More specifically, the slots 326, 328 may be shaped to form an interference fit with the corresponding interference sections 342, 352.

The mating contacts 324, 325 also include interference sections 342, 352, respectively, that have different features than the corresponding interference section 214. With respect to the mating contact 324, a corresponding path of the interference section 342 extends or egresses into the slot 326. The interference section 342 includes an orthogonal segment 360 that extends parallel to an orientation axis 393 and substantially perpendicular to a mating axis 391. The retention insert 322 includes a shoulder section 362 that partially defines the slot 326. The shoulder section 362 directly engages the orthogonal segment 360 to prevent the mating contact 324 from being displaced in the mating direction. When the contact sub-assembly 306 is inserted into the contact cavity 314, the retention insert 322 and the connector housing 302 may press the mating contact 324 therebetween.

It is to be understood that the above description is intended to be illustrative, and not restrictive. In addition, the above-described embodiments (and/or aspects or features thereof) may be used in combination with each other. Furthermore, many modifications may be made to adapt a particular situation or material to the teachings of the invention without departing from its scope.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing having opposite mating and loading faces and a mating axis extending therebetween, the connector housing having interior walls that oppose each other with a contact cavity therebetween, the contact cavity being accessible through the mating face and through the loading face;

a retention insert sized and shaped to be advanced through the loading face and positioned within the contact cavity, the retention insert having an outer engagement surface; and first and second rows of mating contacts separated by the retention insert, the contact cavity having a component-receiving region that exists between the first and second rows of mating contacts and is accessible through the mating face, the mating contacts of the first and second rows being oriented to extend lengthwise along the mating axis and being held between the engagement surface of the retention insert and respective interior walls, wherein the mating contacts of the first and second rows are configured to engage an electrical component when the electrical component is inserted into the component-receiving region;

wherein the mating contacts of the first and second rows are directly engaged by the engagement surface of the retention insert and wherein the interior walls have contact channels that are configured to receive the mating contacts of the first and second rows, the connector housing engaging and holding the mating contacts of the first and second rows within the corresponding contact channels before the retention insert is positioned within the connector housing between the interior walls.

2. The electrical connector of claim 1, wherein the mating contacts of the first and second rows are gripped by the respective interior walls such that the mating contacts are held within the corresponding contact channels.

3. The electrical connector of claim 1, wherein the mating contacts include interference sections that form an interference fit with the respective interior walls such that the mating contacts are held within the corresponding contact channels.

4. The electrical connector of claim 1, wherein the connector housing has grip elements that project into the contact channels, the grip elements holding the mating contacts of the first and second rows within the corresponding contact channels before the retention insert is positioned within the contact cavity.

5. The electrical connector of claim 1, wherein the mating contacts include orthogonal segments that extend generally perpendicular to the mating axis, the retention insert directly engaging the orthogonal segments.

6. The electrical connector of claim 1, wherein the connector housing engages respective interference sections of the mating contacts, wherein each of the mating contacts has a cross-section along the interference section that includes a width and a thickness, each of the width and the thickness being substantially uniform throughout the cross-section of the interference section.

7. The electrical connector of claim 1, wherein the first and second rows of mating contacts are configured to be deflected away from each other.

8. The electrical connector of claim 1, wherein the contact channels have a corresponding base portion with a first channel width and a corresponding end portion with a second channel width, the end portion being closer to the mating face than the base portion, the second channel width being greater in size than the first channel width.

9. An electrical connector comprising:

a connector housing having opposite mating and loading faces and a mating axis extending therebetween, the connector housing having interior walls that oppose each other with a contact cavity therebetween, the contact cavity being accessible through the mating face and through the loading face;

a retention insert sized and shaped to be advanced through the loading face and positioned within the contact cavity, the retention insert having an outer engagement surface, wherein the interior walls have fixed positions with respect to each other as the retention insert is positioned within the contact cavity between the interior walls; and first and second rows of mating contacts separated by the retention insert, the contact cavity having a component-receiving region that exists between the first and second rows of mating contacts and is accessible through the mating face, the mating contacts of the first and second rows being oriented to extend lengthwise along the mating axis and being held between the engagement surface of the retention insert and respective interior walls, wherein the mating contacts of the first and second rows are configured to engage an electrical component when the electrical component is inserted into the component-receiving region;

wherein the retention insert is capable of independently holding the mating contacts of the first and second rows before the retention insert is moved in a direction along the mating axis through the loading face and positioned between the interior walls.

10. The electrical connector of claim 9, wherein the retention insert includes opposite slot rows that are configured to receive the first and second rows of mating contacts, the slot rows including a plurality of slots that are defined by opposing shoulder surfaces that face each other in opposite directions along the mating axis, the opposing shoulder surfaces of each of the plurality of slots directly engaging and forming an interference fit with an interference section of the corresponding mating contact.

11. The electrical connector of claim 9, wherein the interior walls have contact channels that are configured to receive the mating contacts of the first and second rows, each of the contact channels being defined between a different pair of opposing channel walls, wherein the pair of opposing channel walls define a channel width therebetween that is measured along the longitudinal axis, the channel width being different at different portions of the corresponding contact channel.

12. An electrical connector configured to be mounted and electrically coupled to a circuit board, the electrical connector comprising:

a connector housing having opposite mating and loading faces and a mating axis extending therebetween, the connector housing having interior walls that oppose each other with a contact cavity therebetween, the contact cavity being accessible through the mating face and through the loading face;

a retention insert sized and shaped to be advanced through the loading face and positioned within the contact cavity, the retention insert having an outer engagement surface; and first and second rows of mating contacts separated by the retention insert, the contact cavity having a component-receiving region that exists between the first and second rows of mating contacts and is accessible through the mating face, the mating contacts of the first and second rows being oriented to extend lengthwise along the mating axis and being held between the engagement surface of the retention insert and respective interior walls, wherein the mating contacts of the first and second rows are configured to engage an electrical component when the electrical component is inserted into the component-receiving region, the first and second rows of the mating contacts being parallel to each other along a longitudinal axis;

wherein the interior walls have contact channels that are configured to receive the mating contacts of the first and second rows, each of the contact channels being defined between a different pair of opposing channel walls, wherein the pair of opposing channel walls define a channel width therebetween that is measured along the longitudinal axis, the channel width being different at different portions of the corresponding contact channel.

13. The electrical connector of claim 12, wherein the mating contacts of the first and second rows are directly engaged by the respective interior walls such that the mating contacts are held within the corresponding contact channels.

14. The electrical connector of claim 12, wherein the mating contacts include interference sections that form an interference fit with at least one of the connector housing or the retention insert.

15. The electrical connector of claim 12, wherein the retention insert is capable of independently holding the mating contacts of the first and second rows before the retention insert is positioned within the connector housing.

16. The electrical connector of claim 12, wherein the connector housing has grip elements that project into the contact channels, the grip elements configured to hold the mating contacts of the first and second rows within the corresponding contact channels before the retention insert is positioned within the connector housing.

17. The electrical connector of claim 12, wherein the contact channels have a corresponding base portion with a first channel width and a corresponding end portion with a second channel width, the end portion being closer to the mating face than the base portion, the second channel width being greater in size than the first channel width.

18. An electrical connector comprising:

a connector housing having opposite mating and loading faces and a mating axis extending therebetween, the connector housing having interior walls that oppose each other with a contact cavity therebetween, the contact cavity being accessible through the mating face and through the loading face;

a retention insert sized and shaped to be advanced through the loading face and positioned within the contact cavity, the retention insert having an outer engagement surface; and first and second rows of mating contacts separated by the retention insert, the contact cavity having a component-receiving region that exists between the first and second rows of mating contacts and is accessible through the mating face, the mating contacts of the first and second rows being oriented to extend lengthwise along the mating axis and being held between the engagement surface of the retention insert and respective interior walls, wherein the mating contacts of the first and second rows are configured to engage an electrical component when the electrical component is inserted into the component-receiving region;

wherein the mating contacts of the first and second rows are directly engaged by the engagement surface of the retention insert;

wherein the mating contacts include stamped edges, the stamped edges engaging the electrical component when the electrical component is inserted into the component-receiving region, the stamped edges engaging the engagement surface of the retention insert.

19. The electrical connector of claim 18, wherein the retention insert is held by and between the stamped edges of the first and second rows of mating contacts.

20. The electrical connector of claim 18, wherein the interior walls have contact channels that are configured to receive the mating contacts of the first and second rows, each of the contact channels being defined between a different pair of opposing channel walls, wherein the pair of opposing channel walls define a channel width therebetween that is measured along the longitudinal axis, the channel width being different at different portions of the corresponding contact channel.

* * * * *